US005737842A

United States Patent [19]

Freedman

[11] Patent Number: 5,737,842

[45] Date of Patent: Apr. 14, 1998

[54] CUTTING TOOL

[75] Inventor: Melvin S. Freedman, Beachwood, Ohio

[73] Assignee: The Spoilage Cutter Company, Green Bay, Wis.

[21] Appl. No.: 613,906

[22] Filed: Mar. 11, 1996

[51] Int. Cl.[6] ..... B26B 3/00; B26B 29/06

[52] U.S. Cl. ..... 30/280; 30/294

[58] Field of Search ..... 30/280, 289, 294, 30/317

[56] References Cited

U.S. PATENT DOCUMENTS

| | | | |
|---|---|---|---|
| 521,115 | 6/1894 | Hopper . | |
| 601,315 | 3/1898 | Creveling . | |
| 838,852 | 12/1906 | Eckley . | |
| 1,795,527 | 3/1931 | Tyreman . | |
| 2,120,960 | 6/1938 | Arthur . | |
| 2,187,590 | 1/1940 | Lurie . | |
| 2,619,723 | 12/1952 | Rausch | 30/294 |
| 2,688,187 | 9/1954 | Pauli | 30/294 X |
| 3,583,024 | 6/1971 | Garza . | |
| 3,613,241 | 10/1971 | Allen | 30/294 |
| 3,673,687 | 7/1972 | Phillips et al. . | |
| 3,678,581 | 7/1972 | Bolduc | 30/294 |
| 3,835,536 | 9/1974 | Marcoux | 30/294 |
| 4,134,206 | 1/1979 | Beermann . | |
| 4,631,829 | 12/1986 | Schmidt et al. . | |
| 4,646,437 | 3/1987 | Blomqvist . | |
| 4,837,931 | 6/1989 | Beermann . | |
| 4,868,985 | 9/1989 | Rehm . | |
| 5,046,253 | 9/1991 | Ireland | 30/294 X |
| 5,103,562 | 4/1992 | Braatz . | |
| 5,282,316 | 2/1994 | Anderson . | |
| 5,285,577 | 2/1994 | Carney et al. | 30/294 |

*Primary Examiner*—Eugenia Jones
*Attorney, Agent, or Firm*—Renner, Otto, Boisselle & Sklar

[57] ABSTRACT

A cutting tool for material, such as a web, sheet, slab, packaging or other material includes a dynamic guide slot in which the material is moved while it is bent by cooperative surfaces to stiffen the material and to direct the stiffened material into engagement with a blade for cutting the material. A pointed beak can pierce the material to initiate a cutting operation.

11 Claims, 4 Drawing Sheets

CUTTING TOOL

TECHNICAL FIELD

The present invention relates generally, as indicated, to cutting tools and methods, and, more particularly, to a cutting tool and method in which the material, such as a web, sheet, slab, packaging or other material being cut is resiliently urged into engagement with a cutting blade to facilitate the action of the blade to slice into the material being cut.

BACKGROUND

Various types of cutting tools have been developed in the past. One type of cutting tool is that used to cut relatively flexible sheet material, such as a plastic material, paper material or the like. Usually the thinner the material or smaller the gage, the more flexible and less rigid is the material. Scissors may be used to cut such materials, but a scissors has two blades which must be moved relative to each other to cut the material. The cutting action occurs as the sheet material is forced between the scissors blades. Such cutting action is time consuming and is very tiring when done manually. Also, if the blades do not fit well in engagement, cutting may be impaired or made more difficult.

Another type of cutting tool, which can be held in one hand, is intended to slice through such web or sheet material. An advantage to such a cutting tool is that hand action to operate scissors blades is not needed; therefore, fatigue is reduced and speed of making cuts may be increased. An example of such a tool is disclosed in U.S. Pat. No. 5,282,316. The tool includes a razor blade which is positioned to cut the material which is guided along a slot into engagement with the blade. A cutter for cutting another type of web or sheet material, namely, tape, in this case a bandage, is disclosed in U.S. Pat. No. 3,673,687, and a cutter for still another type of web or sheet material, namely, vehicle safety (seat) belts, is disclosed in U.S. Pat. No. 4,134,206. Each of the cutting tools of the aforementioned patents often suffers from the disadvantage during operation that the material being cut tends to bunch in the slot and against the blade. Such bunching problem may occur prior to the blade initiating a cut, in which case it is difficult to commence cutting and sometimes the bunched material is distorted, e.g., stretched, by the force urging the material and the blade together. Such distortion may make the cut material unacceptable for subsequent use or may increase the difficulty of such use. Still further, such bunching may increase the force, effort, or manipulation requirements to initiate cutting. Moreover, if such bunching continues after the cut has been initiated, the aforesaid difficulties may be encountered and, additionally, the accuracy of the cut, e.g., to follow a straight line or some other pattern may be reduced. Accurate cutting may be especially important to minimize scrap caused by inaccurate cutting through a label or cutting of sheet material to an incorrect size or shape.

Sometimes the bunching problem and/or difficulty in cutting web material is exacerbated when the sheet material is extremely flexible, such as a strip of plastic backing material on which a plurality of thin plastic labels are carried or when the sheet material is strong and difficult to cut, as in the strong web material of an automobile seat belt. Difficulties and problems in cutting also may be caused if the sheet material is not held sufficiently taught and/or if the cutting blade is slightly dulled.

Accordingly, it would be desirable to facilitate the cutting of sheet material.

It also would be desirable to reduce distorting of sheet material when cutting it.

Additionally, it would be desirable to improve the accuracy of cuts through sheet material.

Reference to web material or sheet material means any of the aforesaid and other materials that may be cut using the apparatus and method of the invention.

SUMMARY

With the foregoing in mind, then, one aspect of the invention relates to a cutting tool including a cutting blade for cutting material, a housing for holding the blade in position for cutting, and resilient means for bending the material and guiding the material to the cutting blade for cutting thereby.

Another aspect relates to a cutting tool including a cutting blade for cutting material, a housing for holding the blade in position for cutting, and resilient means for guiding the material to the cutting blade for cutting and urging the material into engagement with the cutting blade.

A further aspect relates to a tool for cutting web material including a cutting blade, surfaces forming a tapered groove for guiding web material toward the blade for cutting thereby, and the blade and apex of the groove being substantially coplanar.

An additional aspect relates to an apparatus for cutting web material including a bending surface for bending the web material as the web material is moved along the bending surface, and a blade aligned with the bending surface for cutting the web material at least approximately at the apex of the bend thereof.

Still another aspect relates to a method of cutting sheet material guiding the sheet material to a cutting blade while simultaneously bending the sheet material along an axis that is substantially coplanar with the cutting blade.

Still a further aspect relates to a guide system for a web cutter having a blade including a convex surface and a concave surface, means for mounting said surfaces in generally parallel relation to form a generally V-shape slot for directing web material therealong for engagement with and cutting by such blade.

Yet another aspect relates to the increasing of stiffness of material in proximity to a cutting blade.

Yet an additional aspect relates to the increasing of stiffness of material in proximity to a cutting blade and maintaining such stiffness during cutting.

The foregoing and other objects, features, aspects and advantages of the invention will become more apparent as the following description proceeds. It will be appreciated that while embodiments of the invention are described herein, the scope of the invention is to be determined by the claims and equivalents thereof. Also, although the invention is described with respect to a hand held cutting tool, it will be appreciated that the concepts of the invention may be utilized in conjunction with other devices, such as machine mounted or operated cutting tools and so forth.

To the accomplishment of the foregoing and related ends, the invention, then, comprises the features hereinafter fully described in the specification and particularly pointed out in the claims, the following description and the annexed drawings setting forth in detail an illustrative embodiment of the invention, this being indicative, however, of but one of the various ways in which the principles of the invention may be suitably employed.

DESCRIPTION

Figure 1A:
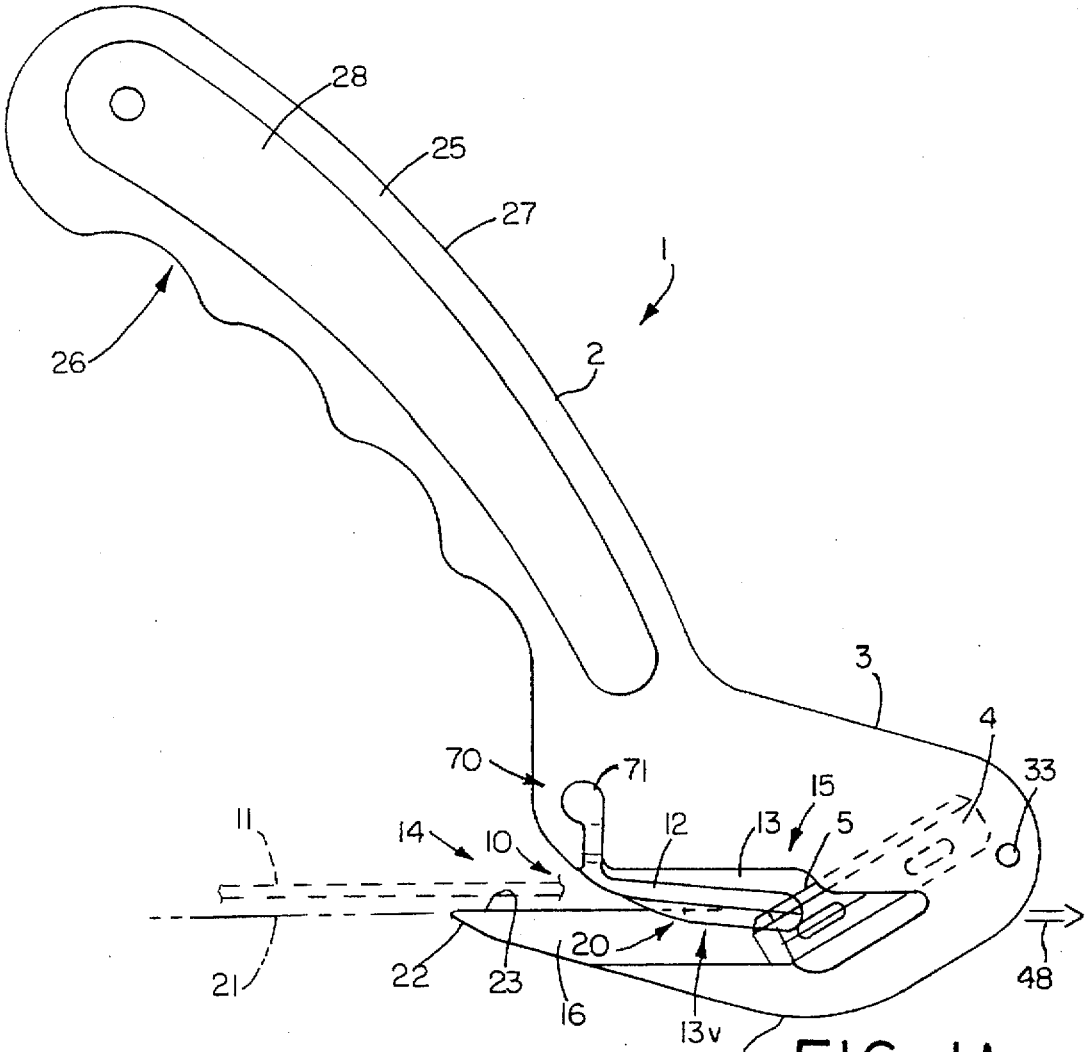
FIG. 1A is a side elevation view of a cutting tool in accordance with the present invention.
Figure 1C:
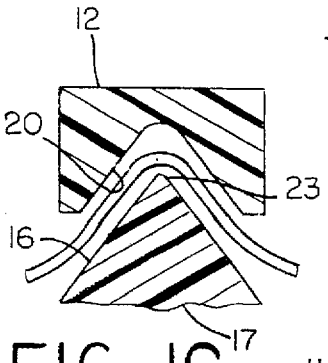
FIG. 1C is a fragmentary section view showing part of the beak and resilient guide member of the tool and the bent paper therein looking generally in the direction of the arrows 1C—1C of FIG. 1B.
Figure 1B:
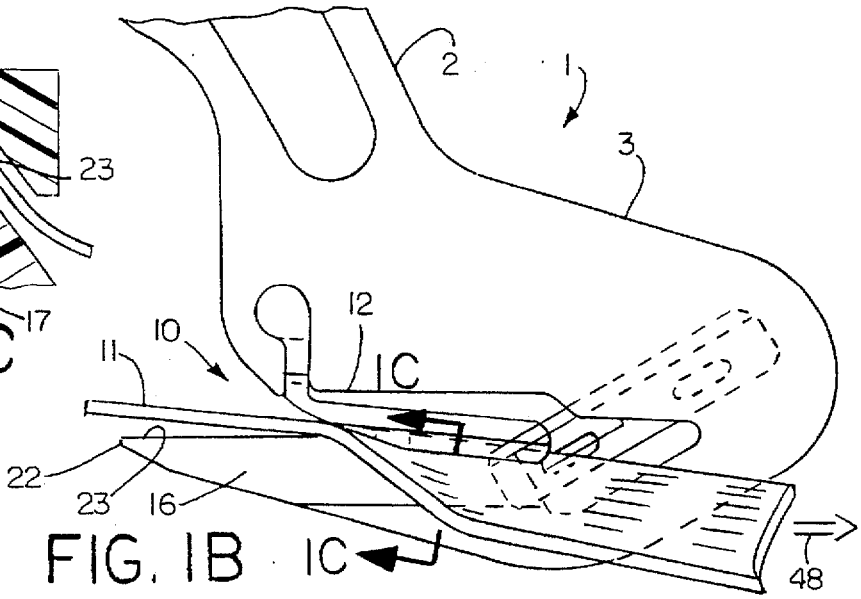
FIG. 1B is a fragmentary side elevation view similar to FIG. 1 but showing schematically the bending of material being cut by the tool.

Referring in detail to the drawings, wherein like reference numerals designate like parts in the several figures, and initially referring to FIGS. 1A, 1B and 1C, a cutting tool in accordance with the present invention is generally indicated at 1. The tool 1 includes a handle 2 and a cutting head or cutting end 3. Within the cutting end 3 is a blade 4, such as a razor blade which has a cutting edge 5 on the body 6 of the blade. As is illustrated, the blade 4 is of the type typically used in a single edge razor cutting device, such as a shaver or some other cutting tool; however, it will be appreciated that other types of blades may be used.

The tool 1 is in the shape of a letter "J" and sometimes is referred to as being of a "J-hook" shape, the handle 2 forming the stem and the cutting head 3 forming the curved base of the J-shape.

A dynamic guide 10 receives the web material intended to be cut by the tool 1 and resiliently urges the material into engagement with the cutting edge 5 of the blade 4 to facilitate cutting of the material by the blade. The dynamic guide also deforms, bends, folds, curves, etc. the material 11 (shown schematically in dotted outline) to facilitate such cutting. Additionally, the dynamic guide 10 tends to maintain a resilient force on the sheet material 11 urging the material into engagement with surfaces of the tool 1 and into engagement with the cutting edge 5 to avoid bunching of the sheet material and to facilitate accurate easy cutting.

The guide 10 includes a flexible guide member 12, which is positioned in a guide slot 13 leading from the open front or entrance end 14 of the dynamic guide 10 toward the inner end 15 of the dynamic guide. The dynamic guide 10 also includes surfaces 16 on the hook or beak portion 17 of the tool 1 facing the guide slot 13.

Cooperation between the flexible guide member 12 and the surfaces 16 in the dynamic guide 10 direct the material 11 to the cutting edge 5 of the blade 4, bends, folds, rolls, etc. the material and causes a resilient urging or forcing of the material 11 into engagement with the cutting edge 5 to be cut or sliced thereby.

The flexible guide member 12 includes surfaces 20 which cooperate with the surfaces 16 to bend, fold, roll, etc. or otherwise form the material 11 into a shape that facilitates cutting by the blade 5. In the illustrated embodiment the axis 21 about which such folding or rolling occurs is at the apex of the pair of surfaces 16. The axis 21 and the cutting edge 5 of the blade 4 preferably are coplanar. The apex or juncture line of respective surfaces 20 of the flexible guide member 12 also preferably is coplanar with the axis 21 and cutting edge 5. Therefore, the surfaces 16, 20 cooperate with each other to shape the material 11 to a configuration that increases effective stiffness of the material as it is urged into engagement with the cutting edge 5. The effectively stiffened material, then, tends not to bunch but rather is slit or otherwise cut by the cutting edge 5. The surfaces 16, 20 also cooperate with each other to tend to support the material in desired shape while further enhancing such stiffness and guiding the material into engagement with the cutting edge 5.

The leading edge or tip 22 of the beak portion 17 of the tool 1 is pointed. The point preferably is sufficiently sharp to facilitate piercing through material, such as plastic sheet material, plastic wrap material, etc., an example being shrink-wrap material. Therefore, the tip 22 can be urged to pierce through such material to commence a cutting operation, and the blade 4 may be used to cut the material.

Although the tip 22 is relatively sharp, preferably it is not so pointed as to cause injury to a user. Also, preferably the area or apex 23 along the axis 21 where the surfaces 16 join is not so sharp as to be knife-like; and this enhances safety of the tool 1. Furthermore, the blade 4 preferably is recessed well back at the inner end 15 of the dynamic guide 10 and in part is shielded by the inner end 24 of the flexible guide member 12 generally to block inserting an object, such as a finger or other object not intended to be cut from the blade for protective purposes.

The cutting tool 1 may be made of plastic material, metal, wood, or some other material. In the illustrated embodiment the tool 1 is made from three plastic parts that are formed by plastic injection molding, including the handle 2 and one portion 3*a* of the cutting head 3, a cover portion 3*b* of the cutting head 3 (illustrated in FIGS. 9–14), and the flexible guide member 12; the blade 4; and one or more fasteners for securing together the aforementioned parts. The blade 4 made be made of metal or some other material, and the fasteners may be of metal, plastic or some other material.

The handle 2 includes an elongate body 25 with a plurality of finger grips 26 to facilitate grasping by the fingers of a user's hand while the palm of the hand engages the edge 27. A recess 28 in the handle body reduces the amount of material required for the handle, may facilitate plastic injection molding and provides a space where the fingers and/or a portion of the palm may rest to help secure a grip on the handle.

In using the cutting tool 1, relative movement between the tool and the material 11 is effected. The material 11 is slid into the dynamic guide 10 and is guided by the flexible guide member 12 and surfaces 16 along the axis 21 for cutting by the blade 4. As the material 11 is so guided, the material is bent by the interaction of the surfaces 16, 20, and, as was elsewhere mentioned herein, preferably the axis about which such bending occurs is coplanar with the axis 21 and the cutting edge 5 of the blade 4. The surfaces 16, 20 cooperate to bound a generally V-shape space whereby the area of the guide slot 13 along which the material 11 is slid is in effect a V-shape guide. The flexible guide member 12 is flexible, and as the material 11 is urged along the guide slot 13 from the front or entrance 14 thereof toward the inner end 15 (or the tool 1 is moved along the material 11,) the member 12 resiliently urges the material against the surfaces 16 and into engagement with the blade 4.

In FIGS. 2–22 further details of the cutting tool 1 are illustrated. The main body 30 of the tool 1 includes the handle 2 and one part 3*a* of the cutting head 3. The other part of the cutting head 3 is the cover plate 3*b*, which is shown in detail in FIGS. 9–14. The cover plate 3*b* can be attached to the cutting head portion 3*a* by fasteners 33, such as conventional screw and nut assemblies, which are positioned in respective openings 34, 35. A stop surface 36 on the cutting head portion 3*a* and the stop surface 37 on the cover plate 3*b* are arranged to confront each other when the cover plate is assembled on the cutting head portion 3*a* on the main body 30. The thickness of the cover plate 3*b* preferably is approximately equal to the height of the stop surface 36 so that the cover plate 3*b* and cutting head portion 3*a* form an apparent integral structure along with the handle 2. In the illustrated embodiment the stop surfaces 36, 37 extend across the width of the face of the tool at the area of the cutting head 3.

Figures 2, 3, 4, 5, 6, 7, 8:
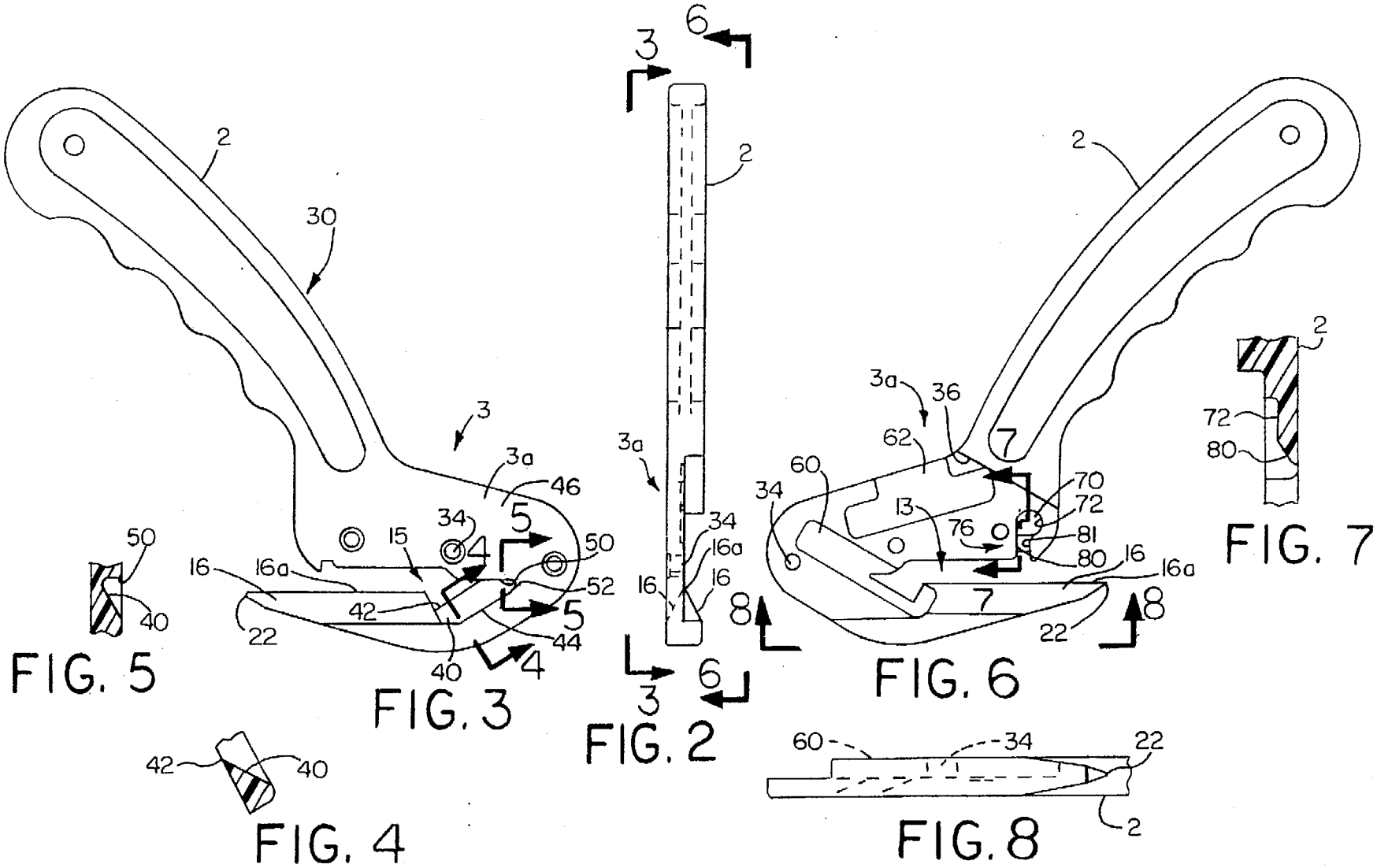
FIG. 2 is a front view of the cutting tool with the cover plate removed.
FIG. 3 is a side elevation view of the cutting tool looking generally in the direction of the arrows 3—3 of FIG. 2.
FIG. 4 is a fragmentary section view looking in the direction of the arrows 4—4 of FIG. 3.
FIG. 5 is a fragmentary section view looking in the direction of the arrows 5—5 of FIG. 3.
FIG. 6 is a side elevation view of the cutting tool looking generally in the direction of the arrow 6—6 of FIG. 2.
FIG. 7 is a section view looking generally in a direction of the staggered line and arrows 7—7 in FIG. 6.
FIG. 8 is a bottom view of the cutting tool looking generally in the direction of the arrows 8—8 of FIG. 6.
Figure 10:
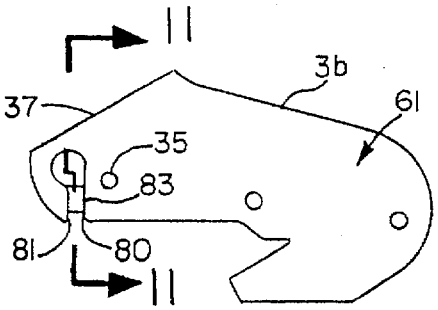
FIG. 10 is a side elevation view of the cover plate looking generally in the direction of the arrows 10—10 of FIG. 9.
Figure 9:
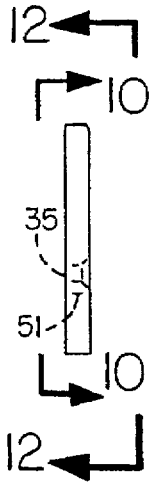
FIG. 9 is a front view of a cover plate for the cutting tool.
Figure 12:
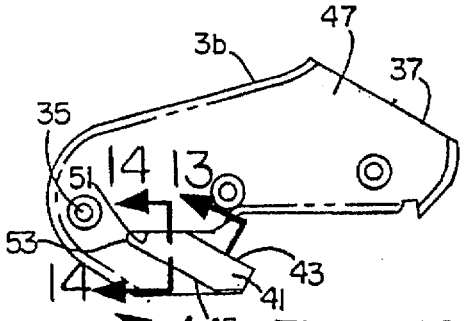
FIG. 12 is a side elevation view of the cover plate looking generally in the direction of the arrows 12—12 of FIG. 9.

As is seen in FIG. 2, the surfaces 16 are part of the cutting head portion 3*a*, and the apex 16*a* of those surfaces is at the location where the surfaces come together to form a V-like shape in cross section. If desired, one of the surfaces 16 may be part of the cover plate 3*b* and the other surface may be part of the cutting head portion 3*a*. Also, although the surfaces 16 form a V-shape cross section, they may form another cross-section, such as a curve or some other shape. The surfaces 16, 20 cooperate to form the desired shape guide slot 13 to increase stiffness of the material 11 and to guide the material to and past the blade 4.

At the inner end 15 of the guide slot 13 are a pair of surfaces 40, 41, which are, respectively, on the cutting head portion 3*a* and cover plate 37. Such surfaces 40, 41 flair or slope outwardly from a relatively narrow spacing therebetween at the edge 42, 43 and to a relatively wide spacing at the location 44, 45 where the respective surface intersects the side surface 46, 47 of the respective portion 3*a* and cover plate 3*b* (see FIGS. 3, 4, 12 and 13).

As is seen in FIGS. 1A, 1B and 1C, relative to the movement of the material 11 in the guide slot 13, the blade cutting edge 5 is upstream of the surfaces 40, 41. After material 11 is cut by the blade, the surfaces 40, 41 smoothly guide the two separated portions of the material 11 beyond the cutting tool 1 in the direction of the arrow 48. Furthermore, respective sloped surfaces 50, 51 also guide the two cut portions of the material 11 in the direction of the arrow 48. In an embodiment, the surfaces 40, 41 merge with respective surfaces 50, 51 at respective apices 52, 53. The arrangement of surfaces 40, 41, surfaces 50, 51, and apices 52, 53 tends to guide the cut material in the direction of the arrow 34 (FIGS. 1A, 1B and 1C) smoothly and without impeding movement of the material past the exterior surfaces 46, 47 of the cutting head 3.

A thin recess or compartment 60 in the cutting head portion 3*a* receives and retains the blade 4 therein. The blade is clamped in the position illustrated in FIG. 1A in the compartment 60 by the confronting surface 61 of the cover plate 3*b*. An additional storage compartment 62 may be provided in the cutting head portion 3*a* to store a spare blade. The compartment 62 also is closed by the confronting surface 61 of the cover plate 3*b*. To remove the blade 4 from the compartment 60, the cover plate 61 may be removed from the cutting head portion 3*a* to expose the blade. The blade then can be removed and replaced by a new blade, if desired. While the cover plate is removed, a spare blade can be placed within or removed from the storage compartment 62.

The position of the blade 4 in the compartment 60 is coordinated with the position of the flexible guide member 12. The flexible guide member 12 may be removed from the cutting tool with the blade 4 to facilitate removing the blade; and the flexible guide member also may be oriented with the blade and inserted with it back into position as is illustrated, for example, in the embodiment of FIG. 1A.

Figure 11:
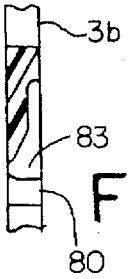
FIG. 11 is a section view looking generally in the direction of the staggered line and arrows 11—11 in FIG. 10.
Figure 13:
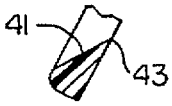
FIG. 13 is a fragmentary section view looking generally in the direction of the arrows 13—13 of FIG. 12.
Figure 14:
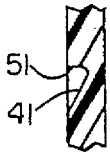
FIG. 14 is a section view looking generally in the direction of the arrows 14—14 of FIG. 12.
Figure 17:
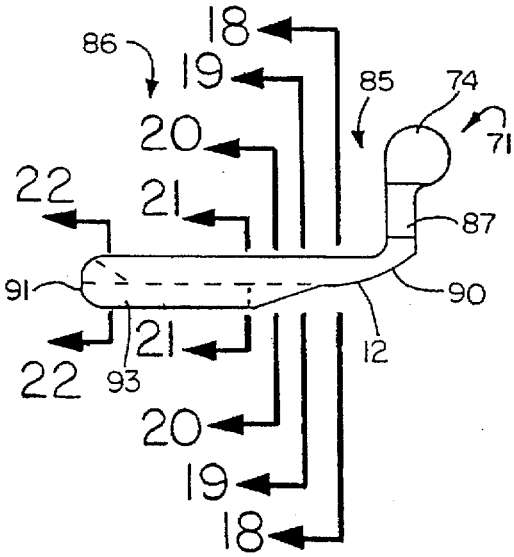
FIG. 17 is a side elevation view of the flexible guide member looking generally in the direction of the arrows 17—17 of FIG. 15.

A socket 70 formed of respective cylindrical (or some other shape for sufficiently secure clamping) socket portions 70*a*, 70*b* in the cutting head portion 3*a* and cover plate 3*b* receives and retains a correspondingly shaped mounting portion 71 (FIGS. 1 and 17) of the flexible guide member 12. The socket 70 receives the correspondingly shaped locking support 74 of the flexible guide member 12. A slot 76 leads from the socket 70 into the guide slot 13. Forward, rear and side walls 80–83 respectively in the cutting head portion 3*a* and in the cover plate 3*b* bound the slot. Respective section views of the socket 70 and slot 76 are illustrated in FIGS. 7 and 11. The cutting head portion 3*a* and cover plate 3*b* cooperate to provide full enclosure for the socket 70 and slot 76 to retain the flexible guide member 12 therein, as is described further with respect to FIGS. 17–22.

Referring to FIGS. 17–22, the flexible guide member 12 includes a support portion 85 and a resilient guide portion 86. The support portion 85 includes the mounting portion 71, locking support 74, and a flared arm 87, all of which fit into respective socket 70 and slot 76 in the cutting head portion 3*a* and cover plate 3*b*. The resilient guide portion 86 of the flexible guide member 12 includes a resilient arm 90, which is of sufficiently thin cross section to allow flexing in the area of the resilient arm 90 and possibly along the length leading to the end 91 so as to facilitate flexing thereof, for example, in the manner of a so-called living hinge. Between the end 91 and the resilient arm 90 of the resilient guide portion 86 are a pair of tapered sloped guide legs 92, 93, which extend partly along the elongate length of the resilient guide portion 86 from the end 91 to near the resilient arm 90. The inner surfaces 20*a*, 20*b* of the respective guide legs 92, 93 face each other and form the surfaces 20 referred to above and generally shown in FIGS. 1A, 1B and 1C.

The surfaces 20*a*, 20*b* form a V-shape area into which the V-shape pair of guide surfaces 16 at the beak 17 of the cutting head 3 of the tool 1 fit to form a V-shape groove to guide the material 11. As the material 11 is guided along the V-shaped groove, it is bent, folded, rolled, etc. to increase stiffness and to guide the apex of the fold to the cutting edge 5 of the blade 4. The legs 92, 93 include flared sloped walls 94, 95, which initially guide the material 11 into the V-shape area 13*v* of the guide slot 13.

Figure 15:
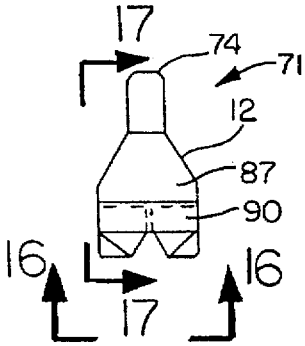
FIG. 15 is a back view of a flexible guide member of the cutting tool.
Figure 16:
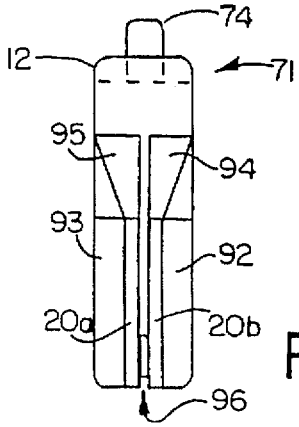
FIG. 16 is a bottom view of the flexible guide member looking generally in the direction of the arrows 16—16 of FIG. 15.
Figure 18:
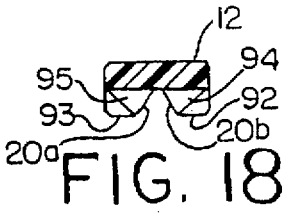
FIGS. 18–22 are respective section views of the flexible side member looking generally in the direction of respective pairs of arrows of corresponding number as shown in FIG. 17.
Figure 19:
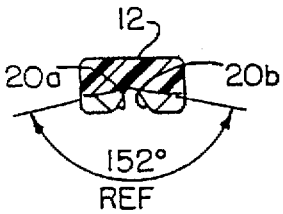
Figure 20:
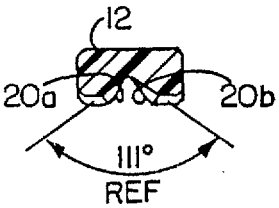
Figure 21:
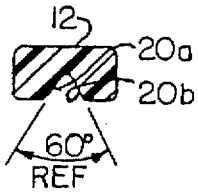
Figure 22:
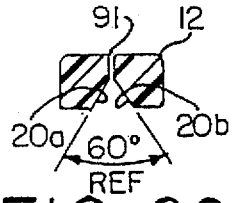

The various tapers and slopes of portions of the resilient guide portion 86 of the flexible guide member 12 are illustrated in the respective drawing FIGS. 18–22 in section and in elevation and plan views in FIGS. 15 and 16.

A slot 96 at the end 91 of the resilient guide portion 86 provides a space for the cutting edge 5 and relatively adjacent portion of the blade 4 to pass through the resilient guide portion adjacent the end 91 thereof. With the cutting edge 5 located partly in the slot 96, cutting of the material 11 while it is relatively securely located in the V-shaped portion 13*v* of the guide slot 13 is assured, and with the flexible guide member 12 providing a resilient force urging the material 11 against the cutting edge 5, the occurrence of bunching is reduced or avoided.

In using the tool 1, material 11 is slid along the guide slot 13 while the flexible guide member 12 and portions of the slot, which is formed by cooperation between respective convex surface area portions established by surfaces 16 and concave surface area portions established by surfaces 20, shape the material to increase stiffness and the guide member urges the material into engagement with the cutting edge 5 of the blade 4. The cut portions of the material 11 are guided by surfaces following the blade cleanly to exit the tool.

As was mentioned above, the tool 1 also may be used to pierce material 11 by urging the tip 22 through the material. It will be appreciated that after such piercing, the tool may be pulled along the material sliding the material along the dynamic guide 10 for cutting by the blade 4. Accordingly, if desired, in such use, the piercing and cutting may be carried out in effect as a substantially continuous action whereby the tip is urged to pierce the material and the tool is pulled along the material to slit, slice, or cut the material as was described above.

Many different materials may be cut using the tool 1. The material may be in the form of a single layer or a sheet of one layer; the material may be plural layers; the material may be plural layers assembled together or formed together in some fashion, such as a bag, or the material may be of some other form. Some examples include relatively thin plastic or paper material, material sometimes referred to as web stock or the like. The tool 1 also may be used to cut other material, such as relatively strong bags or other material. An example is a paper bag or a plastic bag, such as a fifty pound bag, used to contain chemicals, food or other product, etc. The tool may be used to slice off the top of the bag by pinching together the two layers of the bag near the top, and then pulling the tool 1 along a line slightly spaced below the pinch or top edge of the bag, thereby to slice off the top of the bag. In another example, the tool 1 may be used to pierce such a bag with the tip 22 and then drawn along one or both layers of the bag either to slit the bag to cut a hole in the bag or to slit off most of the top, as may be desired. The tool 1 also may be used in many other ways as will be evident to those having ordinary skill in the art.

I claim:

1. A cutting tool, comprising:

a cutting blade for cutting material;

a housing holding the blade in position for cutting, said housing having first surface means for forming a convex area;

second surface means for forming a concave area located relative to the convex area to cooperate with said convex area to bend the material to a curved shape, and said first and second surfaces means and concave and convex areas thereof being located relative to the cutting blade for guiding the material to the cutting blade such that a concave surface of the curved shape material faces the cutting blade for cutting thereby; and resilient means for resiliently supporting said second surface means relative to said first surface means to urge the material toward said first surface means as material is fed toward the cutting blade.

2. The tool of claim 1, said housing being substantially J-shaped.

3. The tool of claim 1, said concave and convex areas forming a V-shaped guide.

4. The tool of claim 1, wherein said resilient means is mounted in said housing relative to said first surface means to resiliently urge said second surface means toward said first surface means to bend the material and thereby to stiffen the material for cutting.

5. The tool of claim 1, further comprising means for piercing the material prior to cutting.

6. The tool of claim 1, said concave area concave area and said convex area being in relatively overlying relation to each other forming a guide to guide the material to the cutting blade.

7. The tool of claim 6, said first and second surfaces means being cooperative for bending the material to increase stiffness thereof.

8. A cutting tool, comprising:

a cutting blade for cutting material;

a housing holding the cutting blade in position for cutting; p1 first surface means located relative to the cutting blade for forming a convex area leading toward said cutting blade;

second surface means for forming a concave area; and resilient support means for resiliently supporting said second surface means relative to said first surface means to locate at least a portion of said convex and concave areas in overlying relation so that the material is urged and guided into engagement with the cutting blade such that a concave surface portion of the material faces the cutting blade for cutting thereby.

9. A cutting tool, comprising:

a cutting blade for cutting material;

a housing holding the blade in position for cutting;

resiliently supported means for bending the material and guiding the material to the cutting blade for cutting thereby;

a resilient support means for resiliently supporting said resiliently supported means; and said housing and said resiliently supported means having respective at least partially overlying portions cooperatively related to bend the material to have a relatively concave surface portion and a relatively convex surface portion and to guide the material such that the concave surface portion faces the blade for cutting thereby.

10. The tool of claim 9, wherein said resiliently supported means stiffens the material for cutting as it passes between the overlying portions.

11. The tool of claim 9, said resiliently supported means having first surface means forming a concave area, and said housing including second surface means forming a convex area, and at least a portion of said concave and convex areas being in overlying relation to form a guide to guide material to the blade for cutting thereby.

* * * * *

UNITED STATES PATENT AND TRADEMARK OFFICE

CERTIFICATE OF CORRECTION

PATENT NO. : 5,737,842

DATED : April 14, 1998

INVENTOR(S) : Melvin S. Freedman

It is certified that error appears in the above-identified patent and that said Letters Patent is hereby corrected as shown below:

In The Claims:

Claim 1, line 9, change "surfaces means" to --surface means--.

Claim 6, line 1, change "said concave area concave area and" to --said concave area and--.

Claim 7, line 1 to line 2, change "surfaces means" to --surface means--.

Claim 8, line 3 to line 4, change "cutting; p1 first" to --cutting; first--.

Signed and Sealed this

Eighteenth Day of August, 1998

Bruce Lehman

*Attest:*

BRUCE LEHMAN

*Attesting Officer*

*Commissioner of Patents and Trademarks*